US007744418B2

(12) United States Patent
He et al.

(10) Patent No.: US 7,744,418 B2
(45) Date of Patent: Jun. 29, 2010

(54) UPRIGHT ELECTRICAL CONNECTOR

(75) Inventors: Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 126 days.

(21) Appl. No.: 11/879,649

(22) Filed: Jul. 18, 2007

(65) Prior Publication Data

US 2008/0020654 A1 Jan. 24, 2008

(30) Foreign Application Priority Data

Aug. 1, 2006 (CN) ..... 2006 2 0076132.3

(51) Int. Cl.
*H01R 13/648* (2006.01)

(52) U.S. Cl. ..... 439/607.35

(58) Field of Classification Search ..... 439/101, 439/108, 502–504, 541.5, 79, 350–358, 855, 439/607.01, 607.23, 607.27, 607.35, 607.36, 439/607.46, 607.55

See application file for complete search history.

(56) References Cited

U.S. PATENT DOCUMENTS 6,315,608 B1 11/2001 Lopata et al.
6,398,587 B1 * 6/2002 Chen et al. ..... 439/607.35
6,419,529 B1 * 7/2002 Shi et al. ..... 439/701
6,447,311 B1 9/2002 Hu et al.
6,863,569 B2 3/2005 Zhu et al.
7,086,901 B2 * 8/2006 Zhang ..... 439/607.56

* cited by examiner

*Primary Examiner*—Edwin A. Leon
(74) *Attorney, Agent, or Firm*—Wei Te Chung; Andrew C. Cheng; Ming Chieh Chang

(57) ABSTRACT

An upright electrical connector for mounting on a PCB includes a bas portion, a first and second mating plate retained in the base portion, a number of first and second contacts held in the first and second mating plate, respectively, an inner shield mounted to the base portion to shield the first and second contacts and an outer shield mounted to the base portion to enclose the inner shield therein. The first and second mating plate includes a first and second tongue portion. The first and second contacts are supported in an inner surface of the first and second tongue portion. An arrangement of the first and a second tongue portions, the first and a second contacts, the inner shield and the outer shield are arranged to configured to a standard IEEE 1394B interface. The first and second tongue portion are perpendicular to the PCB.

14 Claims, 10 Drawing Sheets

UPRIGHT ELECTRICAL CONNECTOR

BACKGROUND OF THE INVENTION

1. Field of the Invention

The present invention to an electrical connector, and particularly to an upright electrical connector.

2. Description of Related Art

With the development of communication and computer technology, electrical connectors for high-speed data transmission are widely used in electronic systems. IEEE1394 (Institute of Electrical and Electronics Engineers; IEEE) connectors are commonly used to connect external and internal peripheral devices to a computer for performing high speed data transmission therebetween. These connectors typically employ a plug connector terminated to a transmission cable and a receptacle connector mounted on a circuit board of the computer.

U.S. Pat. No. 6,315,608 discloses a receptacle connector mounted a circuit board. The receptacle connector comprises an insulative housing having a base portion and a mating portion, a plurality of conductive terminals retained in the housing, an inner shield enclosing the mating portion of the housing for electromagnetic interference protection, and an outer metal shield enclosing both the housing and the inner shield for further electromagnetic interference protection. The mating portion is parallel to the circuit board. The conductive terminals are also arranged in the mating portion in a plane parallel to the circuit board. Nowadays, in the circuit board, there are many electric elements required to be mounted on to perform multiply functions. However, the receptacle connector mentioned above will occupy much area of the circuit board. Under this case, there will be no adequate area to mount other electric elements on the circuit board.

Hence, how to improve the problems in prior art is the major discussion of the present invention.

BRIEF SUMMARY OF THE INVENTION

Accordingly, it is an object of the present invention to provide an electrical connector which will occupy relative small area of a circuit board the electrical connector mounted on.

In order to achieve the above-mentioned object, an upright electrical connector in accordance with the present invention is provided. The upright electrical connector comprises an insulative housing, a plurality of first and second contacts retained in the insulative housing, an inner shield and an outer shield. The insulative housing comprises a base portion and a first and a second mating plates extending forwardly from the base portion. The first/second mating plate include a first/second base plate and a first/second tongue portion. The inner shield encloses the two plates with a receiving slot formed between the inner surface of the plates and the top and bottom walls of the inner shield. The outer metal shield is mounted on the base portion to enclose both the housing and the inner metal shield with gaps formed between four walls of the inner metal shield and corresponding four walls of the outer metal shield. The first and a second tongue portions are perpendicular to the top and bottom walls of the inner shield and the outer shield. The first and a second tongue portions, the first and a second contacts, the inner shield and the outer shield are arranged to configured to a standard IEEE 1394B interface. When the upright connector mounted on the circuit board, the bottom wall of the outer metal shield faces to the circuit board. Under this circumstance, a small area of the circuit board is occupied.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
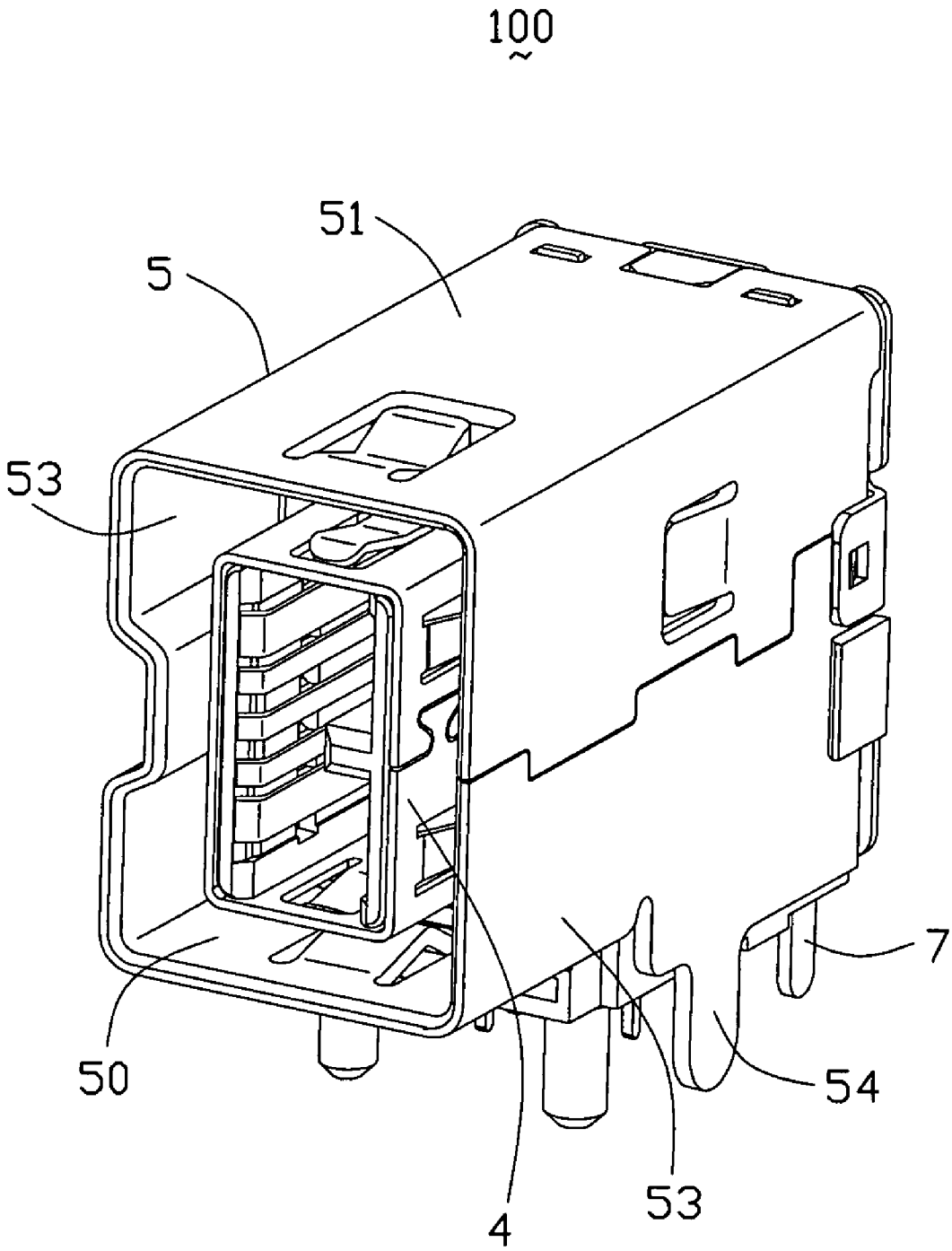
FIG. 1 is a perspective view of an upright electrical connector according to a first embodiment of the present invention.
Figure 2:
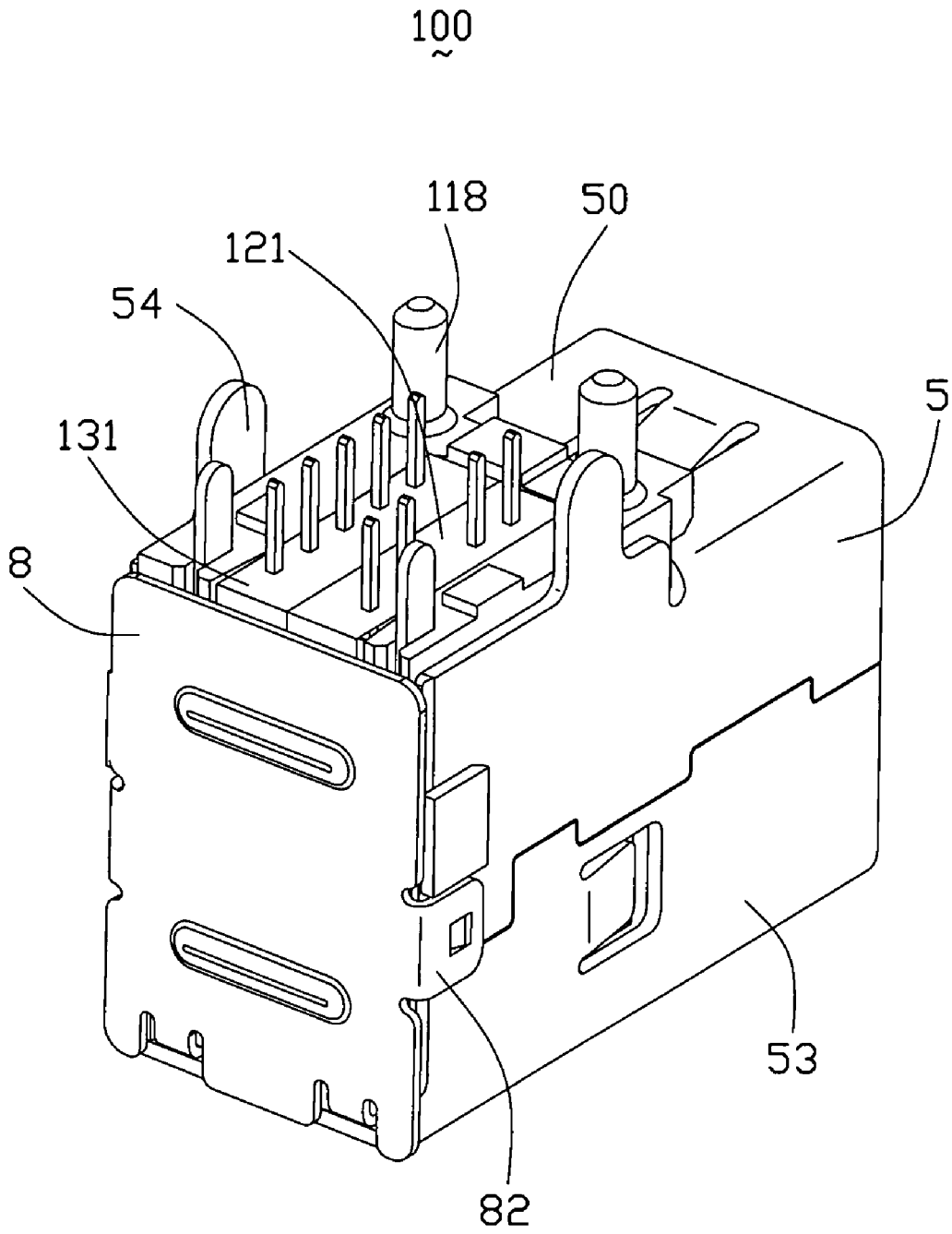
FIG. 2 is another perspective view of the upright electrical connector shown in FIG. 1, while taken from another aspect.
Figure 3:
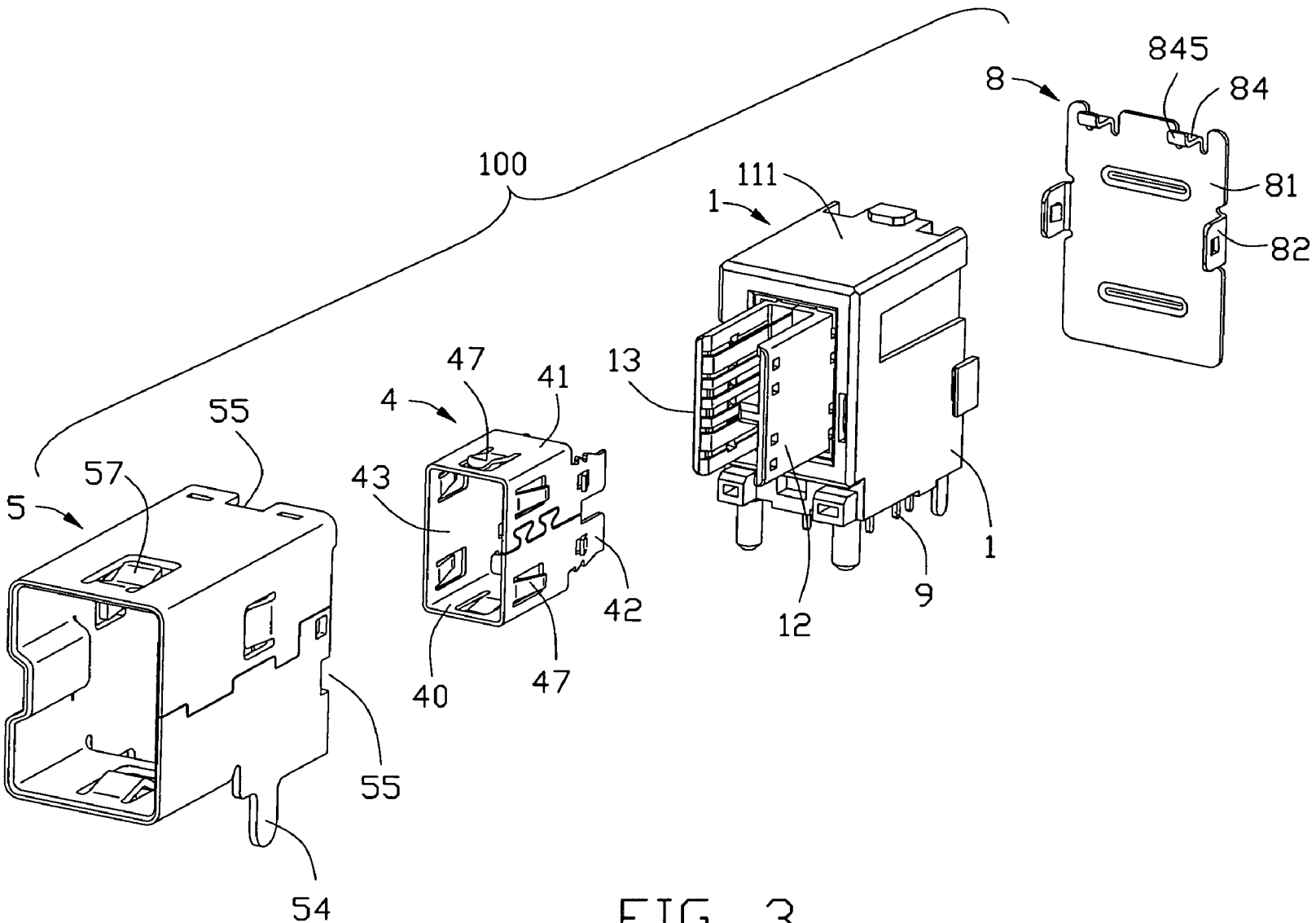
FIG. 3 is a partly exploded perspective view of the upright electrical connector shown in FIG. 1.

Reference will now be made to the drawing figures to describe the present invention in detail.

With reference to FIGS. 1-5, an upright 100 for mounting on a PCB (printed circuit board not shown) with respect to a first preferred embodiment of the present invention is shown. The upright electrical connector 100 comprises an insulative housing 1, a set of first contacts 31 and second contacts 32 retained in the insulative housing 1 for transmitting differential signals, an inner shield 4 mounted on the insulative housing 1 to shield the insulative housing 1 and the first and the second contacts 31 and 32, an outer shield 5 also mounted on the insulative housing 1 to further shield the first and the second contacts 31 and 32, a connecting element 6, a pair of grounding element 7 mounted into the insulative housing and a rear shell 8 mounted on a rear side of the insulative housing 1.

Now, detail description about all elements of the upright electrical connector 100 will be made. To see FIGS. 4 and 5 and in conjunction with FIG. 3, the insulative housing 1 includes a base portion 11, a first mating plate 12 and a second mating plate 13. In this specific embodiment, the base portion 11, the first mating plate 12 and the second mating plate 13 are separated ones. The base portion 11 defines a front-to-rear direction, a top wall 111, a front end 113, a pair of sidewalls 112 connecting with and perpendicular to the top wall 111 and the bottom wall 119, and a receiving cavity 114 enclosed by the top wall 111 and the pair of sidewall 112. The receiving cavity 114 extends in the front-to-rear direction and passes through the base portion 11. A protrusion 115 is formed on each of the top wall 111 and the pair of sidewalls 112. A pair of posts 18 depends from a bottom surface (not labeled) of the pair of sidewalls 112, respectively, for mounting into corresponding through holes of the PCB. Inner surfaces of the pair of the sidewall each are defined with a depressed portion 117.

The pair of sidewalls 112 each further defines with a pair of receiving recess 116 exposed to exterior at a rear end of the base portion 11 to receive the pair of grounding element 7. The first mating plate 12 includes a first base plate 121 and a first tongue portion 122 extending forwardly in the front-to-rear direction. The second mating plate 13 includes a second base plate 131 and a second tongue portion 132 extending forwardly in the front-to-rear direction. The second base plate 131 forms with a hole 135 and a post 133 extending inwardly and perpendicular to second base plate 131.

The first and second contacts 31 and 32 both are in "L" shape. Each of the first contacts 31 includes a first contacting portion 311 extending in the front-to-rear direction, a first tail portion 313 perpendicular to the first contacting portion and a first retaining portion 312 connecting the first tail portion 313 and the first contacting portion 311. Each of the second contacts 32 also includes a second contacting portion 321 extending in the front-to-rear direction, a second tail portion 323 perpendicular to the second contacting portion and a second retaining portion 322 connecting the second tail portion 323 and the second contacting portion 321. In conjunction with FIGS. 1-3, in this specific embodiment, the first and second contacts 31 and 32 are inserted molded in the first and second mating plates 12 and 13, respectively. The first and second tail portions 313, 323 are both extending out the first and second base plate 131 and 121 from a bottom surface thereof. The first and second contacting portions 311, 321 are both located in an inner surface of the first and second tongue portion 122 and 132. The first and the second mating plates 12 and 13 are connected together with the hole 135 and the post 133 of the second mating plate 13 mated with corresponding post and hole of the first mating plates 12. The first and the second mating plates 12 and 13 both are inserted into the receiving cavity 114 from the front end 113 of the base portion 11. After full insertion, the first and second base plate 121 and 131 both are retained in the receiving cavity 114 and the first and second tongue portion 122 and 132 both are outside the base portion 11 as clearly shown in FIG. 3. The first and second tongue portion 122 and 132 are arranged face-to-face. Thus, the first and second contacting portions 311 and 321 are also arranged face-to-face.

The inner shield 4 and the outer shield 5 both are in tube shapes and made of metal sheet. The inner shield 4 defines a top wall 41, a bottom wall 40 and a pair of sidewalls 43 connecting with the top wall 41 and the bottom wall 40. A distance between the top wall 41 and bottom wall 40 is bigger than that between the pair of sidewall 43. The inner shield 4 forms with a plurality of spring arms 47 which are stamped out from the top wall 41 and project inwardly, the bottom wall 40 and the sidewalls 43, and two pairs of legs 42 inserted into depressed portions 117 of the base portion 11 to secure the inner shield to the base portion 11. The first and second tongue portions 122, 132 are enclosed in the inner shield 4 with a receiving slot 101 form between the first and second tongue portions 122, 132 and the top and bottom walls 41, 40 of the inner shield 4. The first and second contacting portions 311, 321 are all exposed to the receiving slot 101 to contacting with corresponding contacting portions of a complementary connector. The outer shield 5 also defines a top wall 51, a bottom wall 50 and a pair of sidewalls 53 connecting with the top wall 51 and the bottom wall 50. A distance between the top wall 51 and bottom wall 50 is bigger than that between the pair of sidewall 53. The outer shield 5 forms with a plurality of second spring arms 57 projecting inwardly on the top wall 51, the bottom wall 50 and the sidewalls 53, and two pairs of mounting legs 54 depending from an bottom edge of the pair of sidewalls 53. The outer shield 5 contains a number of openings 55 formed at a rear end of the top wall 51 and the pair of sidewalls 53. A pair of through locking slots 56 is defined in the top wall 51 and located near the opening 55. Each of the sidewalls 53 is formed with a locking hole 58 near the opening 55 thereof. The out shield 5 is mounted on the base portion 11 to enclose the base portion 11, the first and second contacts 31, 32, and the inner shield 4 with gaps 102 formed between four walls of the inner shield 4 and corresponding four walls of the outer metal shield 5. The openings 55 engage with the protrusions 115 on the base portion 11. The first and second tongue portion 122 and 132 are both perpendicular to the bottom wall 50 of the outer shield 5. In other words, the first and second contacting portions 311 and 321 both are arranged in a plane perpendicular to the bottom wall 50 of the outer shield 5.

Figure 4:
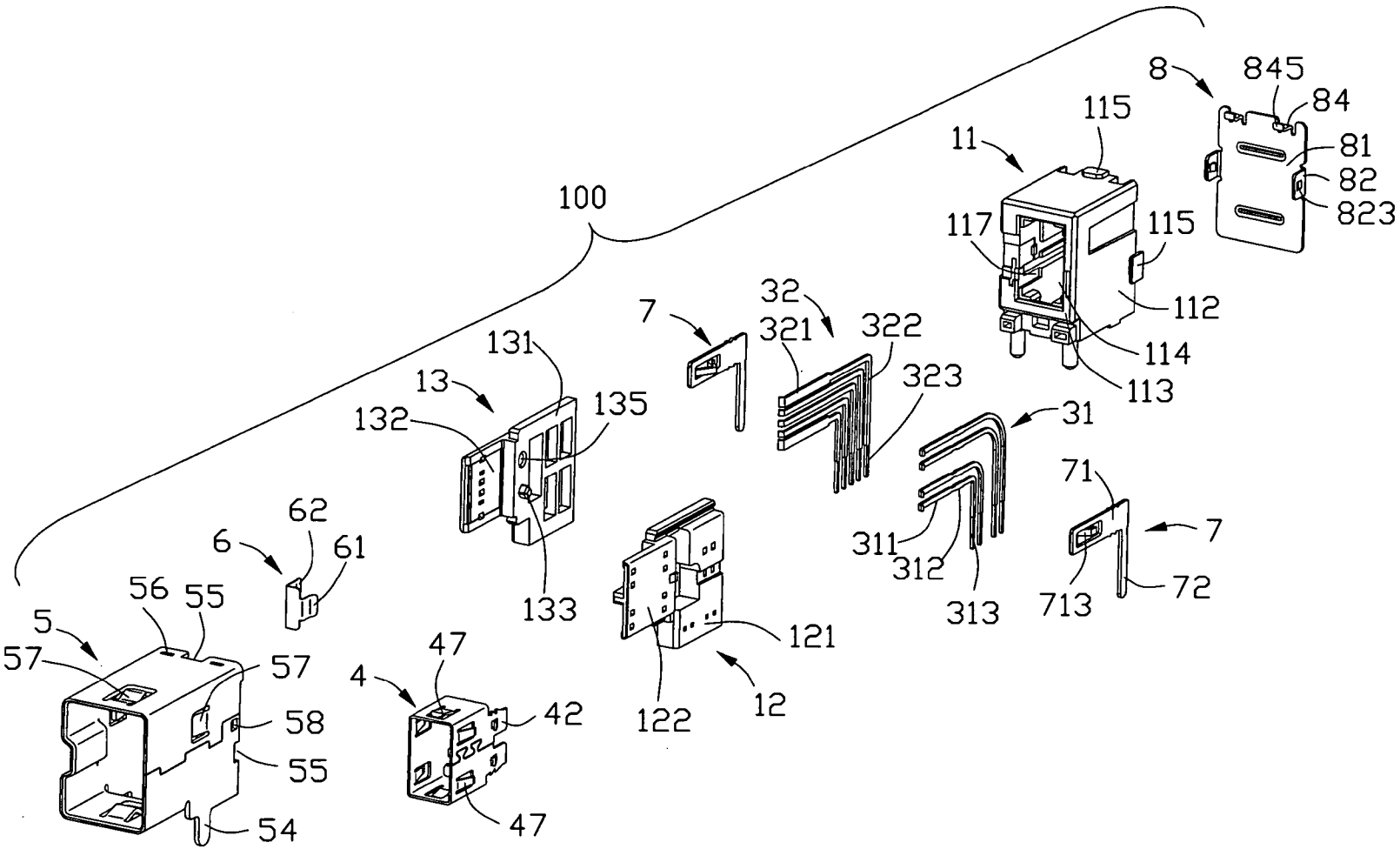
FIG. 4 is a fully exploded perspective view of the upright electrical connector shown in FIG. 1.
Figure 5:
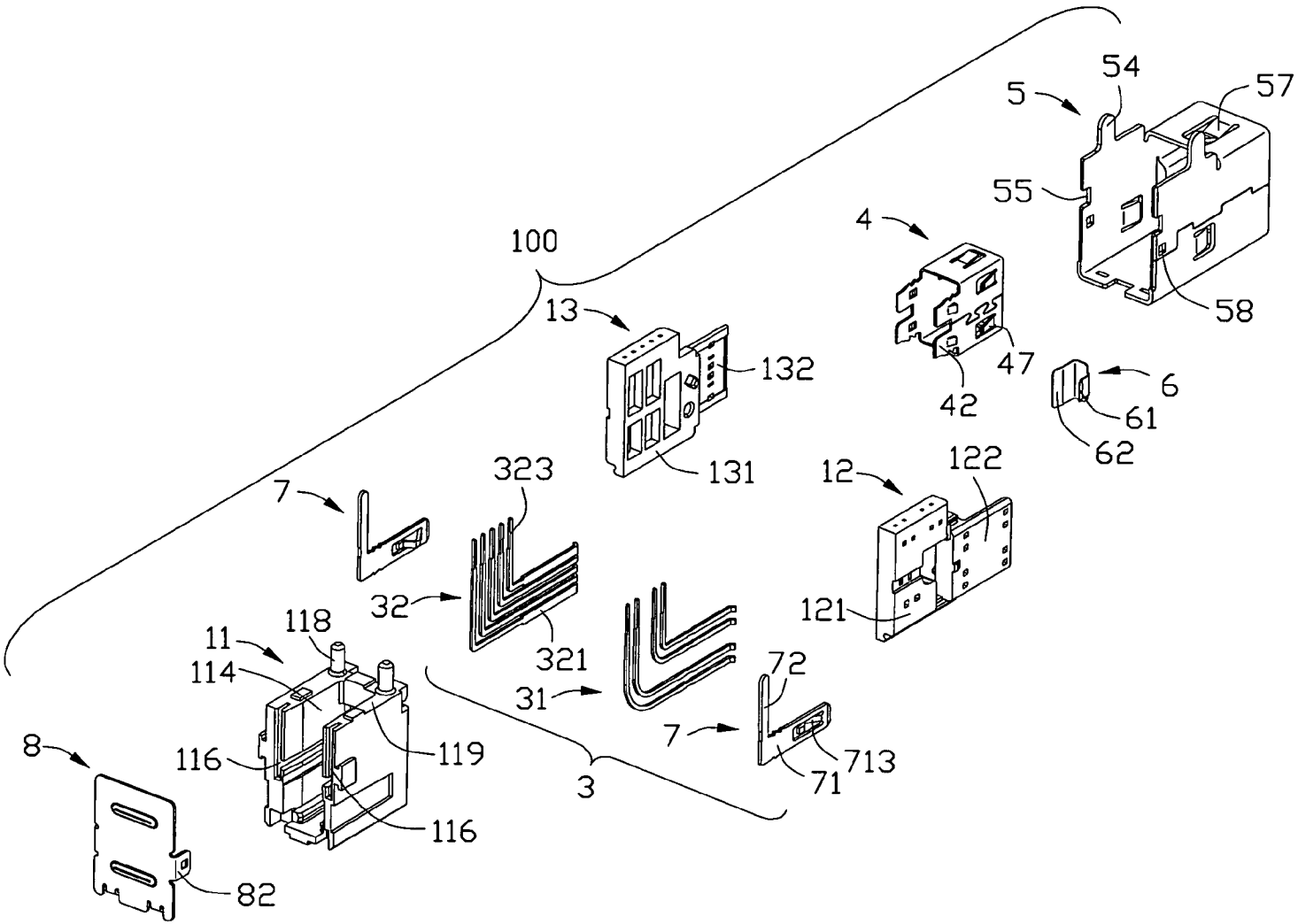
FIG. 5 is a fully exploded perspective view of the upright electrical connector shown in FIG. 2.
Figure 6:
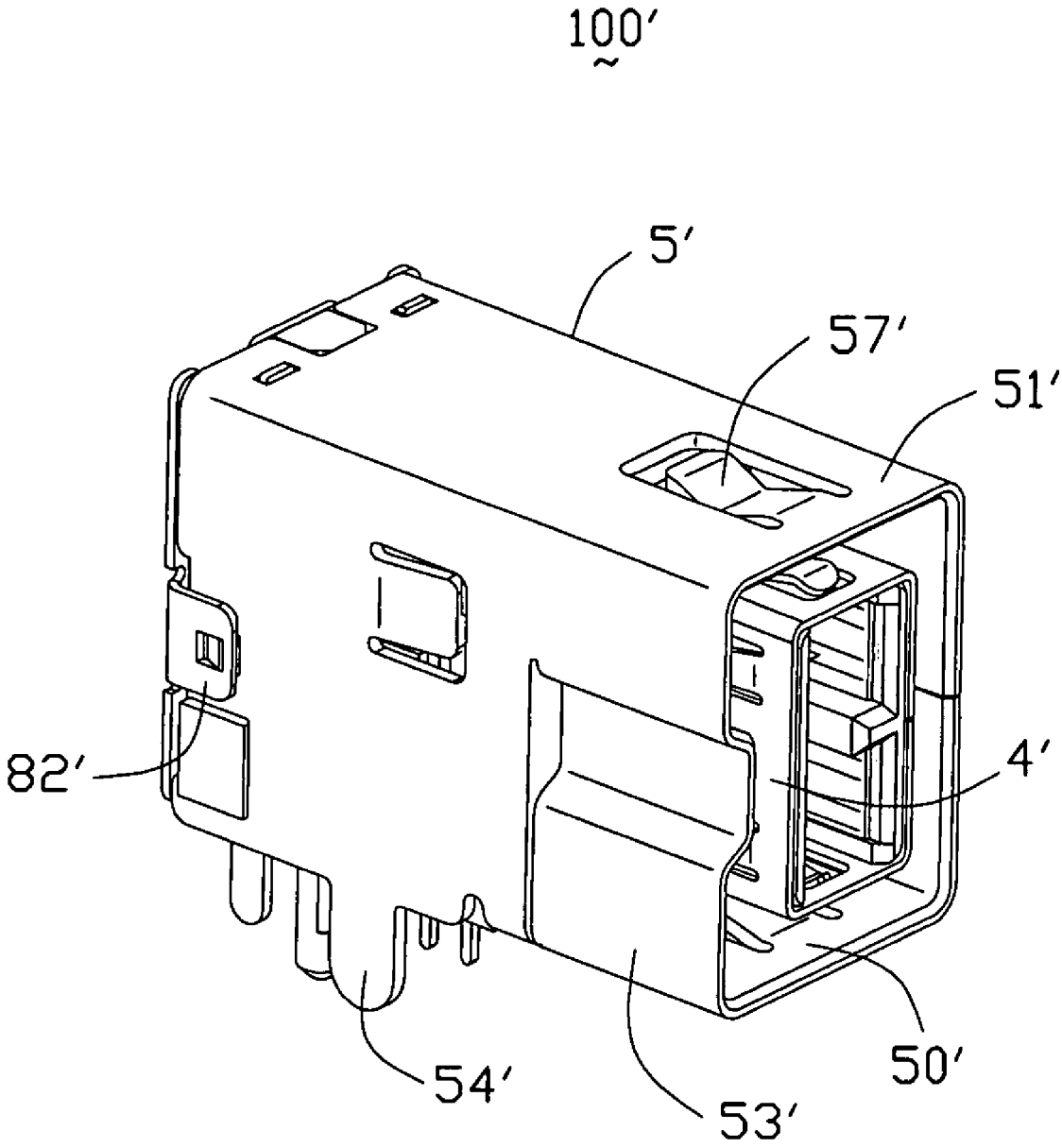
FIG. 6 is a perspective view of an upright electrical connector according to a second embodiment of the present invention.

Referring to FIGS. 4 and 5, the connecting element 6 includes a first connecting potion 61 and a second connecting portion 62. The connecting element 6 is mounted on the base portion 11. The first connecting portion 61 connects with the inner shield 4 and the second connecting portion 62 connects with the outer shield 5. The grounding element 7 is in a "L" shape, including a retaining portion 71 extending in the front-to-rear direction and a grounding leg 72 perpendicular to the retaining portion 71. A flexible arm 713 is stamped out from the retaining portion 71 and protrudes inwardly. After the grounding element 7 retained in its receiving recess 116, the flexible arm 713 contacts the legs 42 of the inner shield 4.

The rear shell 8 is also made of a metal sheet. The rear shell 8 includes a main body 81, a pair of side wing portion 82 extending from side edges of the main body 81 with a projecting tab 823 formed thereon and a pair of extensions 84 protruding forwardly with locking portions 845 formed at free ends thereof. The rear shell 8 mounted to the base portion 11 from a rear side thereof to enclose a rear side of the base portion 11. The locking portions 845 are locked in the locking slots 56 of the outer shield 5 and the projecting tabs 823 are engaged with the locking hole 58 of the outer shield 5.

Arrangement of the outer shield 5, the inner shield 4, the first and second tongue portions 122, 132 and the first and second contacts 31, 32 are configured to a standard IEEE 1394B interface. In application, the first contacts 31 are used to transmitting differential signals. In use, the upright electrical connector 100 is mounted on the PCB with the first and second tail portions 313, 323 all connecting with the PCB and the posts 118 and the mounting legs 54 inserted into corresponding holes defined in the PCB. The bottom wall 50, rather than the sidewalls 53, of the outer shield 5 faces to the PCB. Under this circumstance, a small area of the circuit board is occupied.

Figure 7:
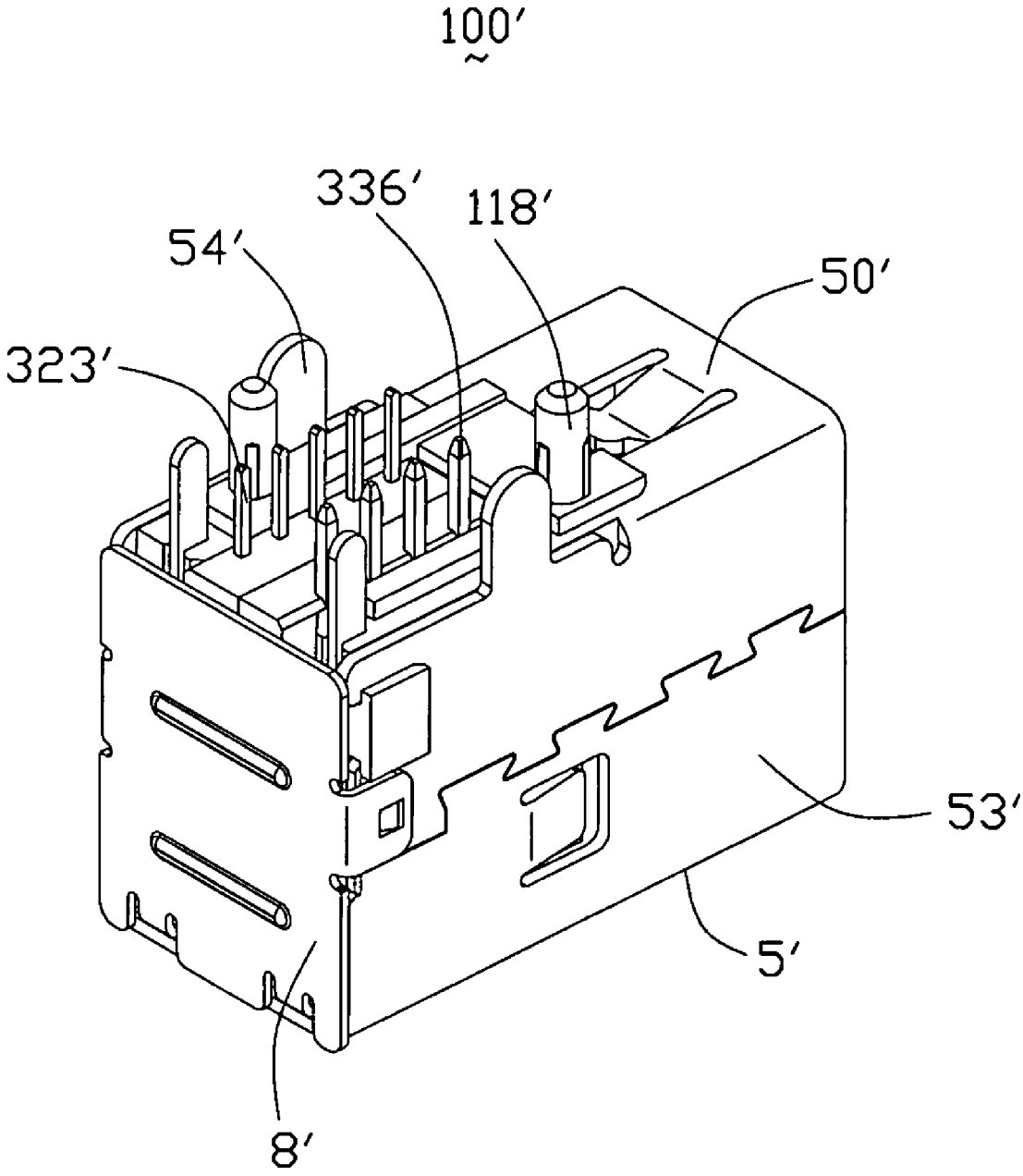
FIG. 7 is another perspective view of the upright electrical connector shown in FIG. 6, while taken from another aspect.
Figure 8:
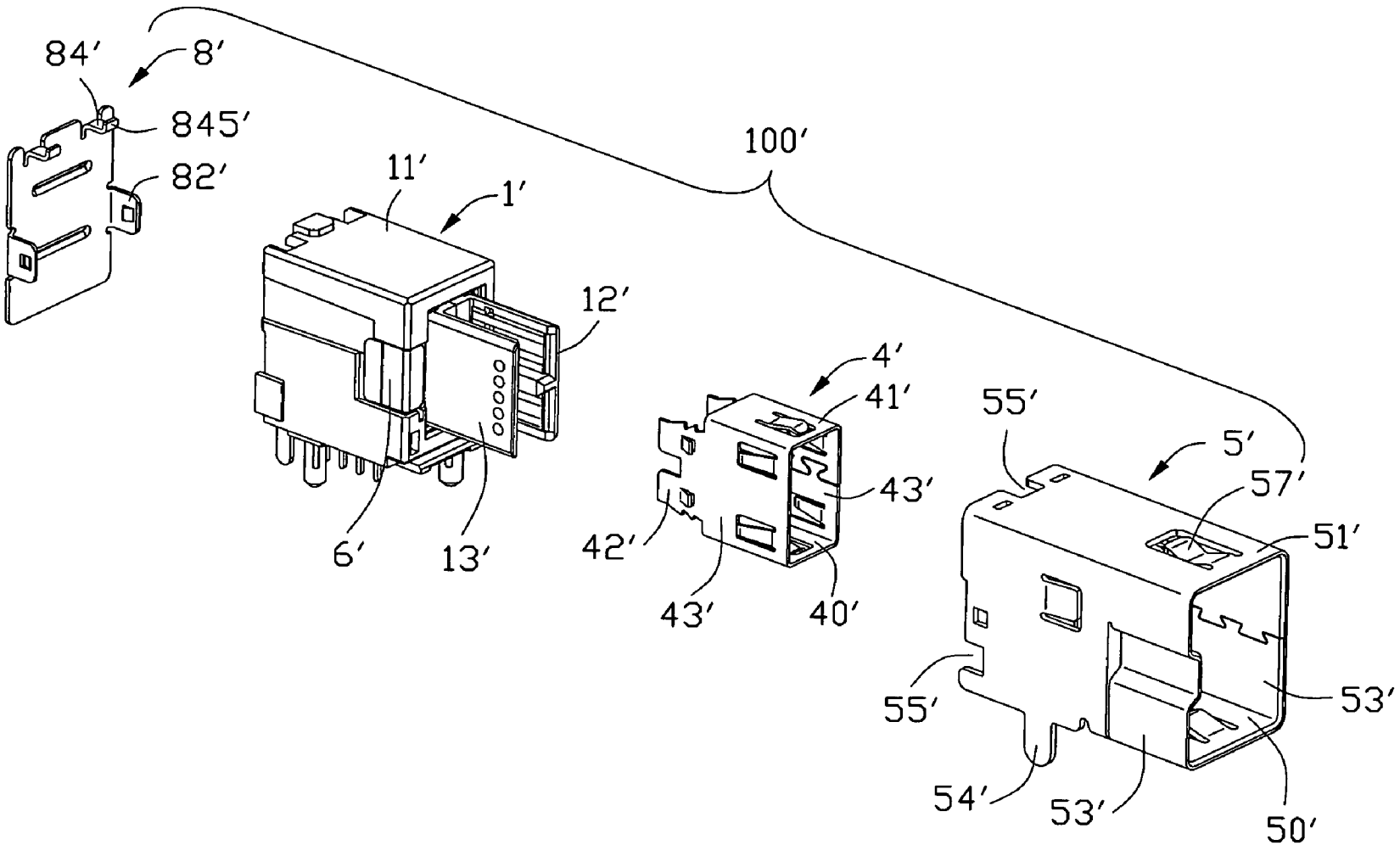
FIG. 8 is a partly exploded perspective view of the upright electrical connector shown in FIG. 6.
Figure 9:
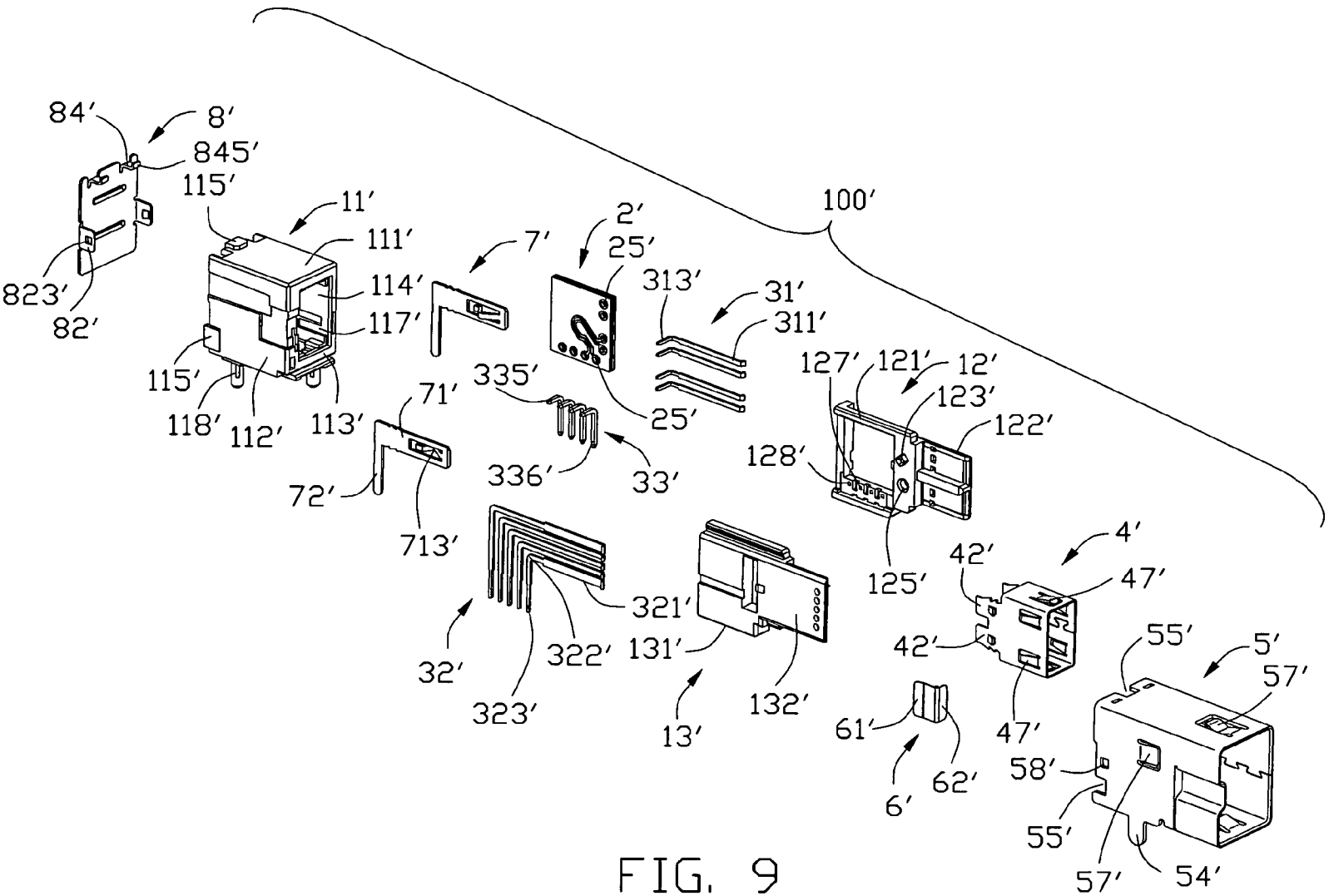
FIG. 9 is a fully exploded perspective view of the upright electrical connector shown in FIG. 6.
Figure 10:
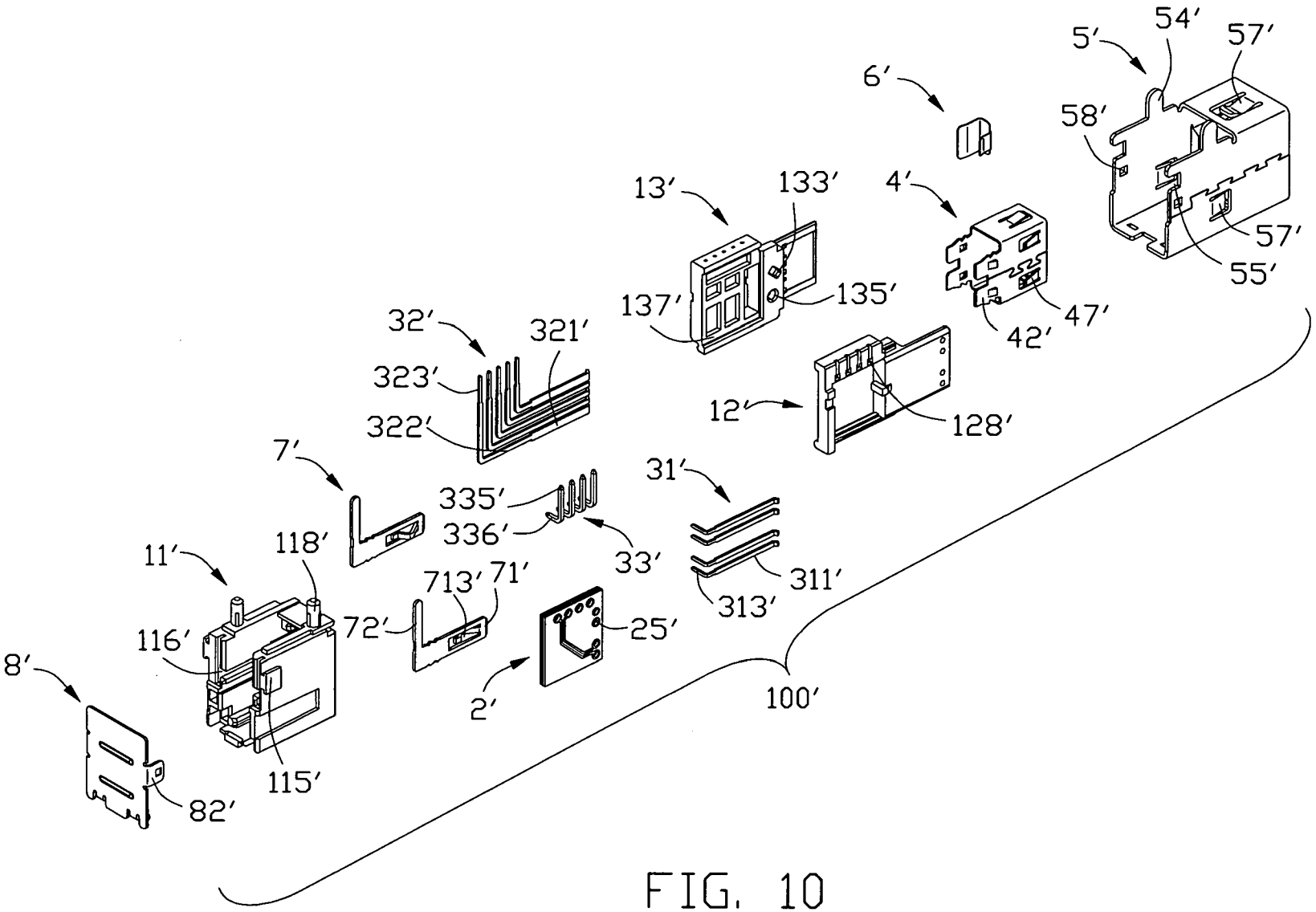
FIG. 10 is a fully exploded perspective view of the upright electrical connector shown in FIG. 7.

With reference to FIGS. 6-10, an upright electrical connector 100' with respect to a second preferred embodiment of the present invention is shown. To facilitate reading the description and viewing the drawing, same elements of the memory card adapter according to different embodiment of the invention are designated with similar numerals and same terminologies. Most of the elements and their arrangements with respect to the present embodiment are similar to those in the first embodiment except the details described below. With respect to the upright electrical connector 100 of the first embodiment, this upright electrical connector 100' further includes an inner PCB 2' and a plurality of third contacts 33'. To accommodate the inner PCB 2', the first and second base plate 121', 131' are both defined a recessed portion 127', 137' in inner sides thereof. The inner PCB 2' is accommodated between the base plate 121' and 131' and is parallel to the first and second tong portion 122' and 132'. A plurality of receiving passageways 128' is defined in a bottom end of the first base plate 12' to accommodate the third contacts 33'. The inner PCB 2' defines a plurality of through holes 25' at a front end and a bottom end thereof. The third contacts 33' each include a connecting portion 335' and a soldering portion 336'. The first tail portions 313 are inserted into through holes 25' at the front end of the inner PCB 2' to electrically connect the first contacts 31' and the inner PCB 2'. The connecting portions 335' are inserted into through holes 25' at the bottom end of the inner PCB 2' to electrically connect the third contacts 33' and the inner PCB 2'. The first contacts 31' and the third contacts 33' are electrically connected through conductive wires on the inner PCB 2'. In this specific embodiment, the first contacts 31' and the inner PCB 2' are mechanically mounted on, rather than insert molded in as the first embodiment, the first mating plate 12' with the soldering portions 336' received in its receiving passageways 128' and extending beyond a bottom surface of the first base plate 121' as shown in FIG. 7. The first contacts 31', the inner PCB 2' and the third contacts 33' together play a function as what of the first contact 31 disclosed in the first embodiment.

Arrangement of the outer shield 5', the inner shield 4', the first and second tongue portions 122', 132' and the first and second contacts 31', 32' are configured to the standard IEEE 1394 B interface. In application, the first contacts 31' are used to transmitting differential signals. In use, the upright electrical connector 100' is mounted on the PCB with the first and second tail portions 313', 323' all connecting with the PCB and the posts 118' and the mounting legs 54' inserted into corresponding holes defined in the PCB. The bottom wall 50', rather than the sidewalls 53', of the outer shield 5' faces to the PCB. Under this circumstance, a small area of the circuit board is occupied. In the second preferred embodiment of the present invention, providing the inner PCB 2' makes the option that the first and third contacts 31' both are in same lengths is available. Thus, transmitting roads of the differential signals through the first and third contacts 31' and the inner PCB is same. The differential signals are transferred synchronously with a high quality.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. Such as, in other embodiments, the first and second mating plates and the base portion are formed as a unitary molded one-piece or the through holes in the inner PCB are changed to conductive pads and accordingly the second and third contacts are surface mounted on the inner PCB. These changes are all obvious to ordinary skill person in the art after reading the subject of the present invention.

We claim:

1. An upright electrical connector for mounting on a printed circuit board (PCB), comprising:

an insulative housing, the insulative housing comprising a base portion, a first and a second tongue portions extending from and outside the base portion forwardly in a front-to-rear direction, a first and a second mating plate received in the base portion, the first mating plate comprising a first base plate and the first tongue portion extending forwardly from the first base plate, the second mating plate comprising a second base plate and the second tongue portion extending forwardly from the second base plate;

a plurality of first and second contacts retained in the insulative housing, the first having first contacting portions held in an inner surface of the first tongue portion, the second contacts having second contacting portions held in an inner surface of the second tongue portion;

an inner shield mounted to the base portion, the inner shield comprising a top wall, a bottom wall opposite to the top wall and a pair of sidewalls connecting the top wall and the bottom wall, the inner shield enclosing the first and the second tongue portions therein with a receiving slot formed between the top wall, the bottom wall and the inner surfaces of the first and the second tongue portions, the first and second contacting portions being exposed to the receiving slot; and an outer shield mounted to the base portion, the outer shield comprising a top wall, a bottom wall opposite to the top wall and a pair of sidewalls connecting the top wall and the bottom wall, the outer shield enclosing the base portion, the first and the second tongue portions and the inner shield therein with gaps formed between the top wall, the bottom wall and the pair of sidewalls of the inner shield and corresponding top wall, bottom wall and sidewalls of the outer metal shield; and wherein the inner surfaces of the first and the second tongue portions are perpendicular to the top and bottom walls of the inner shield and the outer shield.

2. The upright electrical connector as claimed in claim 1, wherein the first and the second tongue portions, the first and the second contacts, the inner shield and the outer shield are arranged to configured to a standard IEEE 1394B interface.

3. The upright electrical connector as claimed in claim 1, wherein at least one of the first and second contacts is insert molded in corresponding the first or the second mating plate.

4. The upright electrical connector as claimed in claim 1, wherein the first and second base plates are in the base portion and the first and second tongue portions are outside the base portion.

5. The upright electrical connector as claimed in claim 4, wherein the first, the second mating plate and the base portion are separate ones and mechanically connecting together to form the insulative housing.

6. The upright electrical connector as claimed in claim 1, further comprising an inner PCB and a plurality of third contacts retained in the insulative housing, wherein the inner PCB is parallel to the first and second tongue portions.

7. The upright electrical connector as claimed in claim 6, wherein both of the first and second base plate define a recessed portion to accommodate the inner PCB therebetween.

8. The upright electrical connector as claimed in claim 6, wherein the first and the third contacts being electrically connected via the inner PCB, one end of each of the third contacts connected with the inner PCB and another end of each of the third contacts connected with the PCB.

9. The upright electrical connector as claimed in claim 8, wherein lengths of the first contacts are same and lengths of the second contacts are also same.

10. An upright electrical connector for mounting on a PCB (Printed Circuited Board), comprising:

an insulative housing, the insulative housing comprising a base portion, a first and a second tongue portions extending from and outside the base portion forwardly in a front-to-rear direction, the first and the second tongue portions being perpendicular to the outer PCB;

a plurality of first and second contacts retained in the insulative housing, the first having first contacting portions held in an inner surface of the first tongue portion, the second contacts having second contacting portions held in an inner surface of the second tongue portion;

an inner shield mounted to the base portion, the inner shield comprising a top wall, a bottom wall opposite to the top wall and a pair of sidewalls connecting the top wall and the bottom wall, the inner shield enclosing the first and the second tongue portions therein with a receiving slot formed between the top wall, the bottom wall and the inner surfaces of the first and the second tongue portions, the first and second contacting portions being exposed to the receiving slot; and an outer shield mounted to the base portion, the outer shield comprising a top wall, a bottom wall opposite to the top wall and a pair of sidewalls connecting the top wall and the bottom wall, the outer shield enclosing the base portion, the first and the second tongue portions and the inner shield therein with gaps formed between the top wall, the bottom wall and the pair of sidewalls of the inner shield and corresponding top wall, bottom wall and sidewalls of the outer metal shield;

a connecting element remained in the base portion, the connecting element having a first connecting portion contacting the inner shield and the second connecting portion contacting the outer shield.

11. The upright electrical connector as claimed in claim 10, wherein the first and the second tongue portions, the first and the second contacts, the inner shield and the outer shield are arranged to configured to a standard IEEE 1394B interface.

12. The upright electrical connector as claimed in claim 10, further comprising a pair of grounding elements, wherein the base portion defines a pair of receiving passageways at a rear end thereof to accommodate the pair of the grounding elements.

13. The upright electrical connector as claimed in claim 12, wherein each of the grounding elements comprises a grounding leg connecting with the outer PCB and a retaining portion retained in the base portion and connecting with the inner shield.

14. The upright electrical connector as claimed in claim 13, wherein the retaining portion of each of the grounding elements forms with a flexible arm projecting inwardly to contact the inner shield.

* * * * *